US006477948B1

(12) United States Patent
Nissing et al.

(10) Patent No.: US 6,477,948 B1
(45) Date of Patent: Nov. 12, 2002

(54) MEANS FOR ENHANCING PRINT COLOR DENSITY

(75) Inventors: Nicholas James Nissing, Cincinnati; Mary Elizabeth Elam, Wilmington, both of OH (US)

(73) Assignee: The Proctor & Gamble Company, Cincinnati, OH (US)

( * ) Notice: Subject to any disclaimer, the term of this patent is extended or adjusted under 35 U.S.C. 154(b) by 0 days.

(21) Appl. No.: 09/638,237

(22) Filed: Aug. 14, 2000

(51) Int. Cl.[7] ..... B41M 1/14
(52) U.S. Cl. ..... 101/211; 101/483; 106/31.6
(58) Field of Search ..... 101/211, 483; 8/543; 106/31.49, 31.6; 347/98, 101, 102, 105; 156/240

(56) References Cited

U.S. PATENT DOCUMENTS

| | | | | | |
|---|---|---|---|---|---|
| 4,108,597 | A | | 8/1978 | Mueller et al. | 8/115 |
| 4,599,627 | A | * | 7/1986 | Vollert | 347/101 |
| 4,877,686 | A | * | 10/1989 | Riou et al. | 347/105 |
| 5,371,531 | A | * | 12/1994 | Rezanka et al. | 347/102 |
| 5,458,590 | A | * | 10/1995 | Schleinz et al. | 101/483 |
| 5,501,149 | A | * | 3/1996 | Schleinz et al. | 101/211 |
| 5,503,076 | A | * | 4/1996 | Yeu | 101/483 |
| 5,520,112 | A | * | 5/1996 | Schleinz et al. | 101/483 |
| 5,526,743 | A | | 6/1996 | Fadner | 101/147 |
| 5,580,410 | A | * | 12/1996 | Johnston | 156/240 |
| 5,695,855 | A | * | 12/1997 | Yeo et al. | 347/101 |
| 5,764,263 | A | * | 6/1998 | Lin | 347/101 |
| 5,853,469 | A | * | 12/1998 | Colt et al. | 106/31.49 |
| 5,858,514 | A | * | 1/1999 | Bolvers | 347/102 |
| 6,096,412 | A | | 8/2000 | McFarland et al. | 428/211 |
| 6,177,188 | B1 | * | 1/2001 | Ichiura et al. | 347/105 |
| 6,241,787 | B1 | * | 6/2001 | Nigam | 8/543 |
| 6,281,269 | B1 | * | 8/2001 | Schut | 106/31.6 |

FOREIGN PATENT DOCUMENTS

EP 0 414 015 A2 2/1991

OTHER PUBLICATIONS

R.J.M. Kool: "Entwicklungen im Textildruckbereich" Melliand Textilberichte., vol. 73, No. 12, Dec. 1992, pp. 969–974, XP000339143 Heidelberg DE.

* cited by examiner

*Primary Examiner*—Eugene H. Eickholt
(74) *Attorney, Agent, or Firm*—Julia A. Glazer; Stephen T. Murphy; David M. Weirich

(57) ABSTRACT

A method for enhancing the color density of printed paper comprising a print enhancing fluid. The print enhancing fluid is applied to the paper prior to ink application in order to enhance the color density of the image printed on the paper. Utilization of the print enhancing fluid of this invention also provides improved printing press hygiene and printing process efficiency especially when printing paper products having high color density images.

23 Claims, 5 Drawing Sheets

(4 of 5 Drawing Sheet(s) Filed in Color)

MEANS FOR ENHANCING PRINT COLOR DENSITY

TECHNICAL FIELD

This invention relates to a method for printing substrates comprising a print enhancing fluid.

BACKGROUND OF THE INVENTION

Applying images to substrates by utilizing pigment or dye based ink compositions is well known in the art. These images are generally applied for the purpose of making the article more aesthetically pleasing to the consumer.

One of the difficulties historically experienced with printed substrates (for example absorbent disposable paper products such as facial tissue, bath tissue, table napkins, wipes, diapers, woven disposable fabrics, nonwovens, wovens, cotton pads, and the like) that are printed with pigment based ink compositions is the tendency for the ink to rub-off of the surface of the paper upon exposure of the paper to liquids. The problem is even more pronounced for those absorbent disposable paper products printed with inks exhibiting relatively high color densities.

The tendency for the ink to rub-off of the printed paper product increases as the printed paper is exposed to liquids such as tap water. Furthermore, exposing the printed paper to common household cleaning products containing solventized alkaline liquids, or acid-containing cleaning liquids tends to increase ink rub-off as compared to exposure of the paper to tap water alone.

Commonly assigned U.S. Pat. No. 6,096,412 issued to McFarland et al. on Aug. 1, 2000, teaches an absorbent disposable paper product printed with inks which exhibit resistance to rub-off.

One of the drawbacks associated with using rub resistant inks relates to printing press hygiene. Inks which adhere well to the substrate often exhibit similar properties when in contact with the printing press. In particular, the print plates tend to accumulate ink deposits which can eventually lead to print defects in the printed substrate. In order to prevent print defects more frequent cleaning of the printing press is necessitated. This can lead to reduced printing process efficiency and increased cost associated with the installation and maintenance of printing press cleaning equipment.

Another drawback relating to printing substrates with pigment based ink compositions is the cost of the ink. The cost of the ink represents a substantial raw material cost in relation to the production of the printed paper products. A significant portion of the cost of the ink is due to the pigment concentration of the ink. For example, in order to produce printed paper products which exhibit high color density print images, a high concentration of ink pigment is required (i.e.; the color density of the print image is proportional to the concentration of ink pigment utilized to print the image). Therefore, all else being equal, a higher concentration of ink pigment yields a higher print density, but at a higher cost. The cost becomes an especially relevant factor when printing on highly absorbent paper products.

Yet further, when printing halftone dots with ink, one way to vary color density is by varying the size of the halftone dots. During the printing process, as the halftone dot is applied to the substrate with the ink an increase in halftone dot diameter on the substrate is typically observed. This is as a result of the wet ink spreading on the substrate. This increase in halftone dot diameter is referred to as dot gain.

Dot gain is one factor which impacts the color density of the printed substrate's image area. Historically, dot gain has been viewed as a drawback of halftone dot printing as it tends to degrade the fine detail within the image area. Furthermore, dot gain does not allow for selective ink spreading on the substrate. Yet further, it does not provide variable color density in a given printed area. Because of these drawbacks, efforts have been made through the years to devise printing techniques which minimize dot gain.

It would be desirable to produce a printed substrate having higher color density images without the need to use more concentrated ink. It would also be desirable to produce printed substrates such as printed paper products without the need to use rub-resistant ink compositions. Furthermore, it would be desirable to vary color density in a given print region of the-substrate by controlling the spreading of wet ink in this region.

It is surprising to find that the print enhancing fluid of the present invention when applied to a substrate prior to the ink enhances the color density of the printed substrate image area without requiring the use of more concentrated ink or rub-resistant ink compositions. Furthermore, it allows color density in a given print region to be varied by controlling the spreading of the wet ink on the substrate.

The benefit of this invention is the ability to provide substrates such as printed paper products having print images which exhibit rub resistance and higher color densities without the need for more concentrated ink or rub-resistant ink compositions. As the present invention is capable of providing print images which exhibit rub resistance and higher color densities without the need for more concentrated ink formulations or rub-resistant ink compositions, the raw material cost to produce the products of the present invention is lower. This invention also provides a method for printing variable color densities within the same print region. Yet further the invention has broad applicability to a range of printing inks, substrates, and printing processes.

SUMMARY OF THE INVENTION

This invention relates to a method for printing indicia on a substrate. The substrate has a first outer surface and a second outer surface. A print enhancing fluid is applied to at least one of the first outer surface and the second outer surface of the substrate. An indicia comprised of ink is then applied to at least one of the first outer surface and the second outer surface of the substrate.

The print enhancing fluid is miscible with the ink. It can be a polar or non-polar fluid. It can be hydrophilic or hydrophobic. It can be in the form of a solution or emulsion.

It can be applied to the substrate by any printing method including but not limited to ink jet, silk screen, rotogravure, letterpress, intaglio, lithography, and flexography.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE INVENTION

Figure 1A:
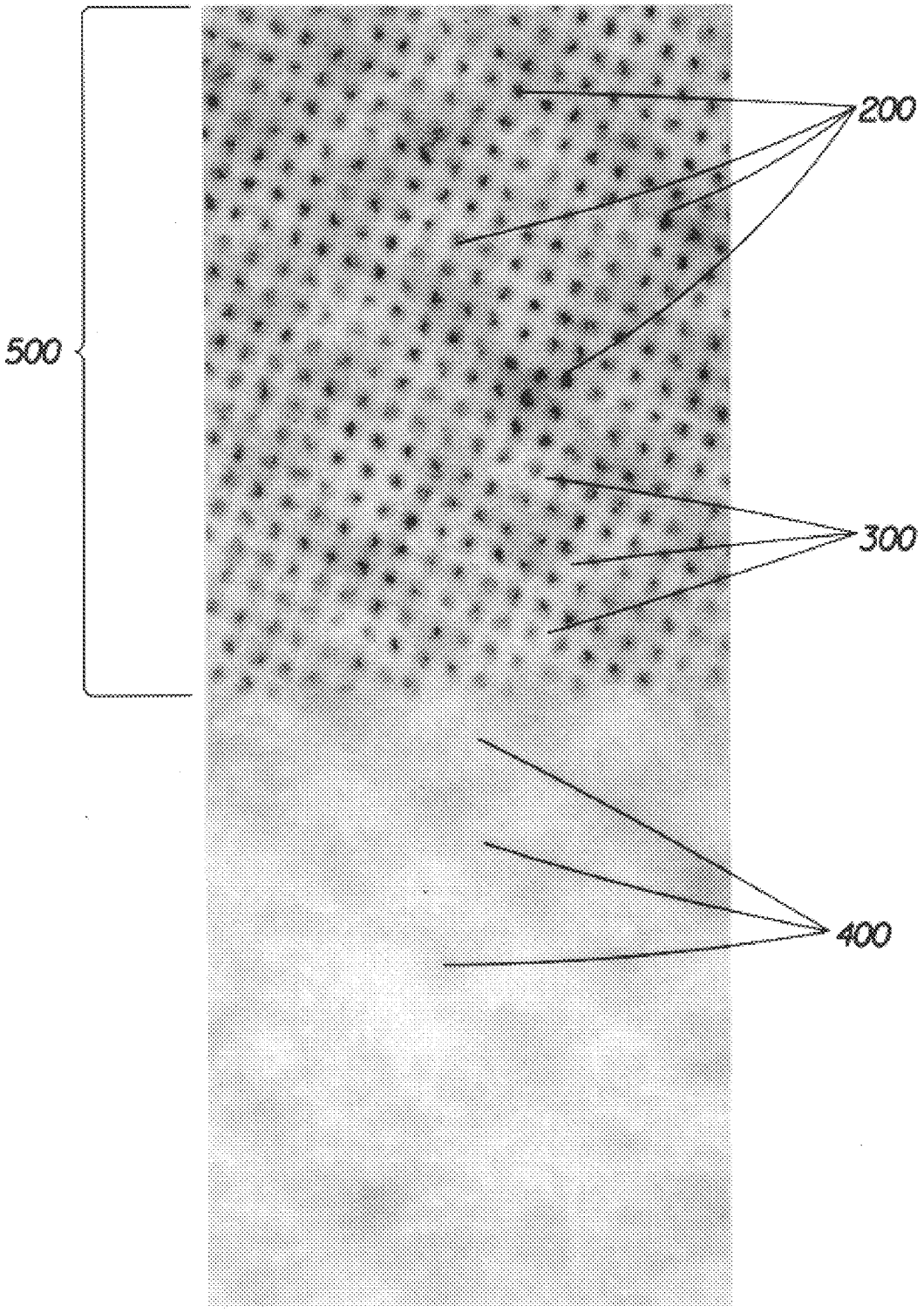
Fig. 1A (PRIOR ART)
FIG. 1A is flexographically printed indicia according to the prior art.

In order to enhance the aesthetics of absorbent disposable paper products, it is desirable to use pigment based inks which produce vibrant high color densities when applied to the absorbent disposable paper product. As used herein, "color density" may be defined by the following equation:

$$D=\log_{10}I/R$$

wherein I, refers to the intensity of incident light, and R, refers to the intensity of reflected light.

Traditionally, when using a single color ink to print images comprised of individual print elements such as halftone dots, the macroscopic color density in a given region of the print image is adjusted by either varying the size or frequency of the individual print element.

When using a single color ink to print images comprised of individual print elements, the present invention allows the color density in a given print region to be varied without requiring a change in the size or frequency of the individual print element.

As used herein, "rub-off" refers to the transfer of color from the surface of a printed substrate to another surface. Rub-off is composed of two components, bleed and abrasion. Bleed refers to the tendency of color to leach out of a substrate upon exposure of the substrate to a liquid. Abrasion refers to the ability to remove ink from a substrate by mechanically scuffing the ink from the surface of the substrate.

As used herein, "print element" refers to the individual indicium which comprises the print image. A non-limiting example of a print element would be a halftone dot. A plurality of halftone dots comprise the print image.

As used herein, "image area", "print region", or "print area" are interchangeable terms which refer to the macroscopic region or area of the paper which exhibits the print image.

As used herein "microscopic region" refers to any region which is approximately the size of an individual print element.

As used herein "macroscopic region" refers to any region which can be resolved by the naked human eye at a distance of about 0.8 meters or greater.

As used herein, "halftone image" refers to print images comprised of discrete dots.

As used herein, "dot gain" refers to the expansion in the size of the individual halftone dot as it is transferred from the printing plate to the substrate. This increase in dot size is resultant from the spreading of the wet ink as it contacts the substrate.

As used herein, "% dot coverage" refers to the amount of a specified print area covered by halftone dots in relation to the total specified print area.

As used herein, "substrate color density", refers to the color density of the unprinted areas of the substrate. A non-limiting example which illustrates this definition would be a paper product printed by the flexographic printing process. For a paper product printed by the flexographic printing process, substrate color density would refer to the areas of the printed paper product not contacted by the ink (i.e.; the unprinted areas of the paper product).

As used herein "background color density" refers to the color density surrounding each individual print element within the image area of the printed substrate. For example, in a traditional printing process when printing images comprised of dots, in a given image area, assuming that dot coverage in a particular print region is less than 100%, background color density is that of substrate color density. In contrast, when printing according to the present invention assuming dot coverage is less than 100%, background color density may be greater than that of substrate color density and less than that of print element color density.

As used herein "print element color density" refers to the color density of each individual print element within the image area of the printed substrate.

As used herein, "variable color density" refers to two or more different color densities found within the same area of the print image.

Figure 2A:
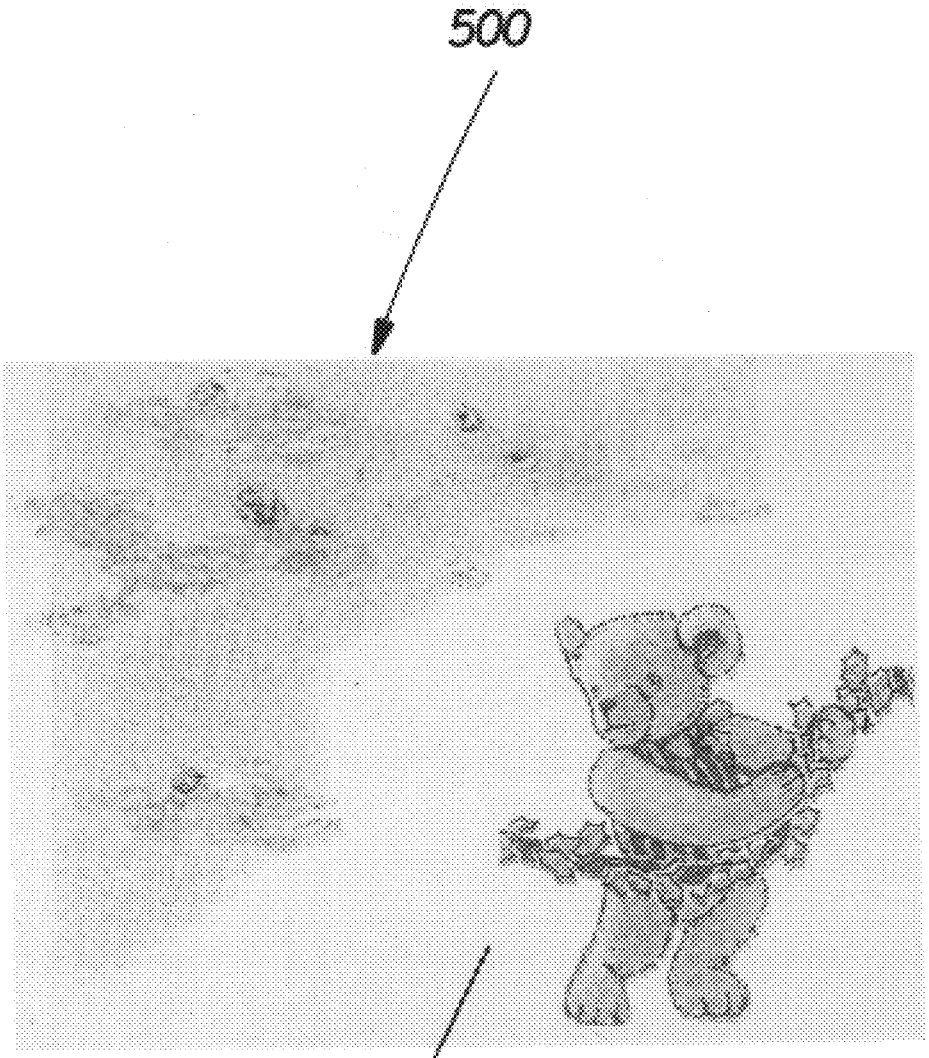
Fig. 2A (PRIOR ART)
FIG. 2A is flexographically printed indicia according to the prior art.

Referring to FIGS. 1A and 2A, printing according to the prior art provides only macroscopic color density variation. FIGS. 1A and 2A are flexographically printed indicia printed according to the prior art. FIG. 1A print image 500 has approximately a 15% dot coverage area. FIG. 1A print image 500 as shown has been magnified approximately 10.8X. There is no variation in the microscopic color density of either FIGS. 1A or 2A. This is because there is only the color density of the print element(s) 200. The background 300 surrounding the print element 200 is the same color density as that of the substrate 400.

Figure 1B:
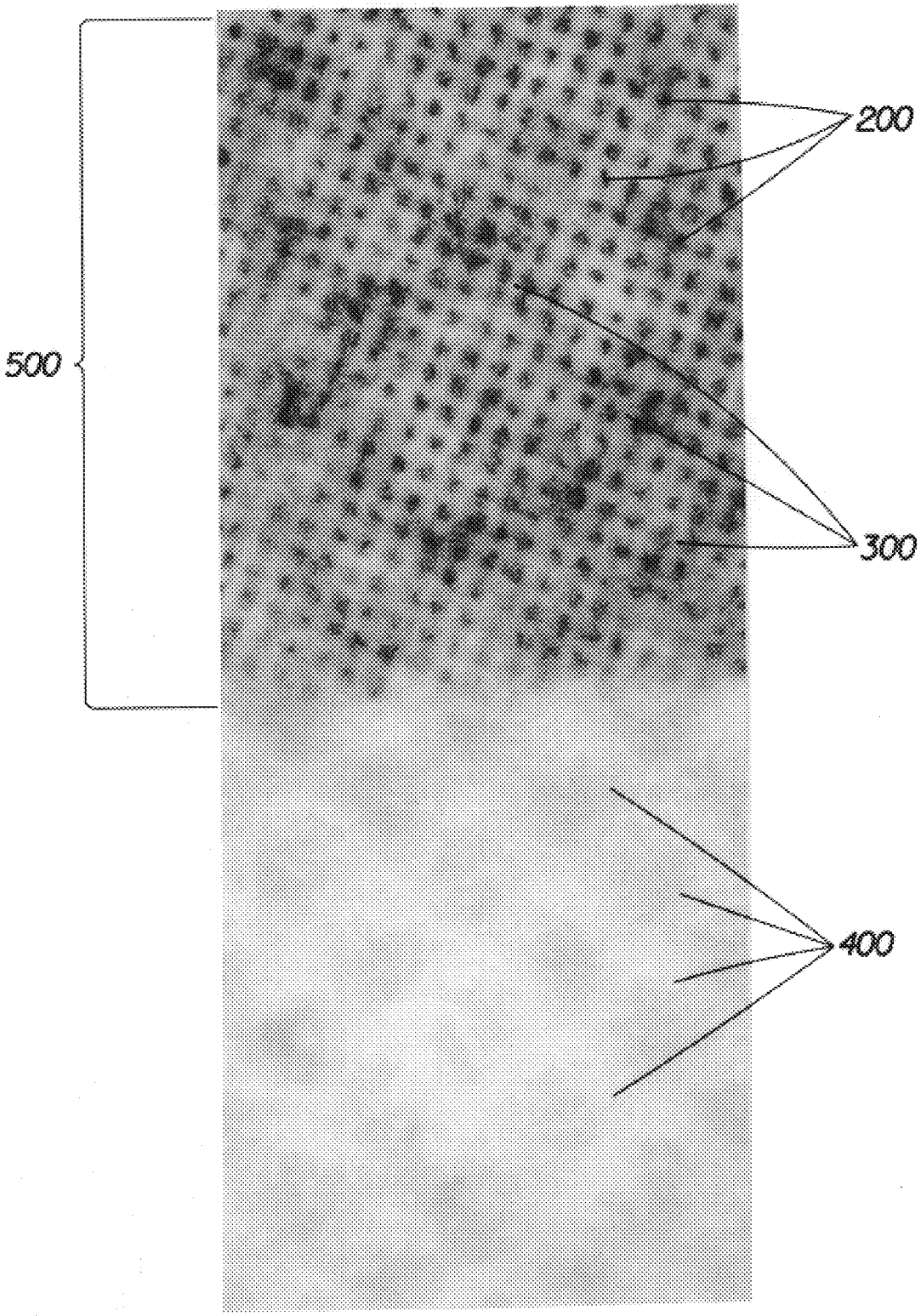
FIG. 1B is flexographically printed indicia according to the present invention.
Figure 2B:
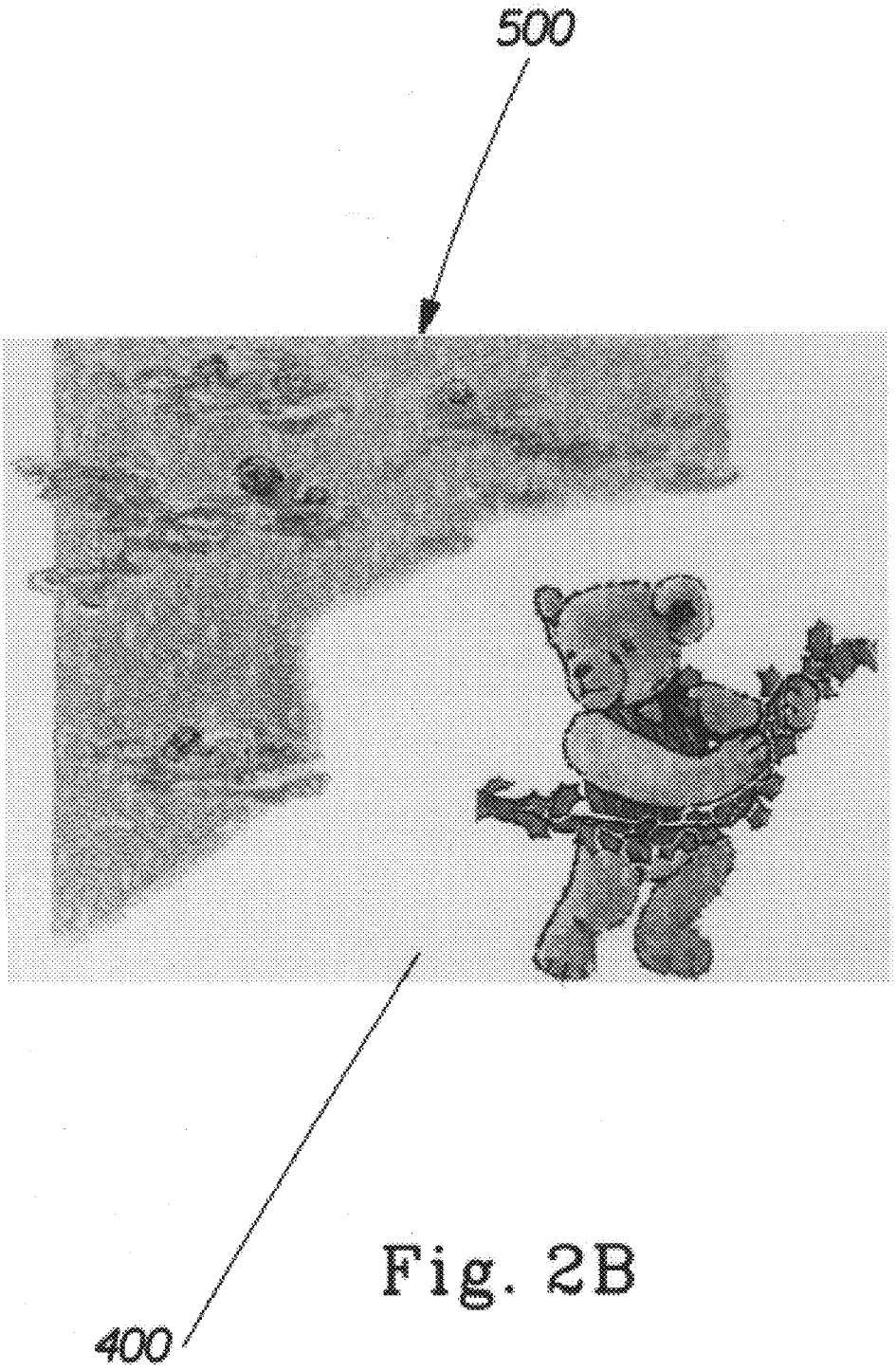
FIG. 2B is flexographically printed indicia according to the present invention.

Referring to FIGS. 1B and 2B, printing according to the present invention provides both macroscopic and microscopic color density variation. FIGS. 1B and 2B are flexographically printed indicia printed according to the present invention. Approximately 11 g/m$^2$ of print enhancing fluid (i.e.; water) was applied to the substrate 400 of both FIG. 1B and FIG. 2B. The print enhancing fluid was applied to the substrate 400 prior to ink application. FIG. 1B print image 500 has approximately a 15% dot coverage area. FIG. 1B print image 500 has been magnified approximately 10.8X.

Images printed according to the present invention exhibit microscopic color density variation. This is because the background 300 surrounding the print element(s) 200 has a color density which is a different color density (i.e.; greater) than that of the substrate 400, and a color density different (i.e.; less) than that of the print element(s) 200. Hence on a microscopic level, the present invention provides at least two distinct color densities (i.e.; that of the print element(s) 200 and the background 300) whereas the prior art such as shown in FIGS. 1A and 2A on a microscopic level only provides a single color density (i.e.; that of the print element (s) 200).

As used herein, "print enhancing fluid" refers to a fluid which is capable of enhancing the color density of a printed area of a printed paper product.

Referring to FIGS. 1A and 2A, in order to adjust the macroscopic color density of a print image 500 in a given print region, it has traditionally required that adjustments be made to the size or frequency of the individual print element (s) 200. These individual print element(s) 200 are reduced in size or frequency such that the lighter background is visible to a larger extent between the print element(s) 200.

While not wishing to be bound by theory, it is believed that this lighter background color lowers the perceived color density because the human eye averages between the color density of the print element(s) 200 and the color density of the unprinted substrate 400.

However, in the case of the present invention, as shown in FIGS. 1B and 2B, it is possible to vary the color density such that more than one color density exists in the same print region without requiring adjustments to the size or frequency of the individual print elements(s) 200. By utilizing the print enhancing fluid of the present invention it is possible for the individual print element(s) 200 to still maintain a higher color density but some amount of the ink migrates into the background 300 regions which are traditionally unprinted. As a result of the ink migration associated with the present invention, the background 300 areas which traditionally exhibit a color density similar to that of the unprinted substrate 400 end up instead having a color density less than that of the individual print element(s) 200 but higher than the unprinted substrate 400.

When printing with halftone dots such as the print element(s) 200, the present invention as illustrated in FIGS. 1B and 2B allows more than one color density to be printed in a given print image 500 region using a single ink color without requiring a change in the size or number of individual print element(s) 200 in a given print image 500 region.

Ink deposition area may be varied by adjusting the frequency, size, or combination thereof of the print element (s) 200 such as halftone dots. The color density of a print element(s) 200 is relatively consistent. Referring to FIG. 1A, in order to adjust the macroscopic color density, traditionally the individual print element(s) 200 are reduced in size or frequency such that the lighter background is visible to a larger extent between the print elements (200). While not wishing to be bound by theory, this lighter background color lowers the perceived density because the human eye averages between the printed element(s) 200 and the unprinted background 300 regions.

The present invention relates to a substrate having an ink composition applied thereon. The individual components of the ink composition may be applied to the substrate as a mixture or sequentially. A print enhancing fluid is applied to the substrate prior to ink application in order to enhance the color density of the image printed on the sheet.

Substrate

The present invention may be used in conjunction with any type of substrate which may be printed. The substrate may include materials which are cellulosic, noncellulosic, or a combination thereof. Examples of such substrates include but are not limited to textiles (e.g.; woven and non woven fabrics and the like) and preferably absorbent disposable paper products. Non-limiting examples of absorbent disposable paper products include toweling, facial tissue, bath tissue, table napkins, plates, wipes, diapers, incontinence garments, cotton pads, and the like.

Preferably the substrate is an absorbent disposable paper product, such as tissue, towel, or the like having a basis weight of between about 10 $g/m^2$ to 130 $g/m^2$, preferably between about 20 $g/m^2$ to 80 $g/m^2$, and most preferably between about 25 $g/m^2$ to 60 $g/m^2$. The substrate of this invention has a first surface and a second surface wherein the second surface is oppositely disposed to the first surface. A print enhancing fluid may be applied to the surface(s) which is to be printed. Ink is applied to at least one of the first and second surfaces.

The substrate of this invention may be made according to commonly assigned U.S. Pat. No. 4,191,609 issued Mar. 4, 1980 to Trokhan; U.S. Pat. No. 4,300,981 issued to Carstens on Nov. 17, 1981; U.S. Pat. No. 4,191,609 issued to Trokhan on Mar. 4, 1980; U.S. Pat. No. 4,514,345 issued to Johnson et al. on Apr. 30, 1985; U.S. Pat. No. 4,528,239 issued to Trokhan on Jul. 9, 1985; U.S. Pat. No. 4,529,480 issued to Trokhan on Jul. 16, 1985; U.S. Pat. No. 4,637,859 issued to Trokhan on Jan. 20, 1987; U.S. Pat. No. 5,245,025 issued to Trokhan et al. on Sep. 14, 1993; U.S. Pat. No. 5,275,700 issued to Trokhan on Jan. 4, 1994; U.S. Pat. No. 5,328,565 issued to Rasch et al. on Jul. 12, 1994; U.S. Pat. No. 5,334,289 issued to Trokhan et al. on Aug. 2, 1994; U.S. Pat. No. 5,364,504 issued to Smurkowski et al. on Nov. 15, 1995; U.S. Pat. No. 5,527,428 issued to Trokhan et al. on Jun. 18, 1996; U.S. Pat. No. 5,556,509 issued to Trokhan et al. on Sep. 17, 1996; U.S. Pat. No. 5,628,876 issued to Ayers et al. on May 13, 1997; U.S. Pat. No. 5,629,052 issued to Trokhan et al. on May 13, 1997; and U.S. Pat. No. 5,637,194 issued to Ampulski et al. on Jun. 10, 1997, the disclosures of which are incorporated herein by reference for the purpose of showing how to make a substrate suitable for use with the present invention.

The substrate may also be made according to U.S. Pat. No. 5,411,636 issued to Hermans et al. on May 2, 1995 and EP 677612 published in the name of Wendt et al. on Oct. 18, 1995.

The substrate of the present invention may be through air dried or conventionally dried. Optionally, it may be foreshortened by creping or by wet microcontraction. Creping and/or wet microcontraction are disclosed in commonly assigned U.S. Patents: U.S. Pat. No. 6,048,938 issued to Neal et al. on Apr. 11, 2000; U.S. Pat. No. 5,942,085 issued to Neal et al. on Aug. 24, 1999; U.S. Pat. No. 5,865,950 issued to Vinson et al. on Feb. 2, 1999; U.S. Pat. No. 4,440,597 issued to Wells et al. on Apr. 3, 1984; U.S. Pat. No. 4,191,756 issued to Sawdai on May 4, 1980; and U.S. Ser. No. 09/042,936 filed Mar. 17, 1998, the disclosures of which patents are incorporated herein by reference.

Ink

The ink composition of the present invention is any liquid composition which may be applied onto the substrate in a predetermined pattern.

Components of the ink composition may include but are not limited to: a vehicle such as a solvent or water; a colorant such as a pigment or dye; a binder; and other components which may include but are not limited to wax, crosslinking agents, fixatives, pH control agents, viscosity modifiers, defoamers, dispersants, printing press hygiene control agents, preservatives, and corrosion control agents.

As used herein, "ink" refers to any composition or components thereof applied to the substrate and which remains thereon in a visible pattern even though components of the ink may evaporate. The components of the ink composition may be applied to the substrate sequentially or as a mixture. A "predetermined pattern" or "image" or "indicia" refers to any desired array or application of ink onto the substrate and is inclusive of all combinations of patterns ranging from small individual dots to complete coating of the entire surface of the substrate.

As used herein, "vehicle" refers to the liquid component of the ink composition utilized to convey the ink composition to the surface of the substrate. As used herein, "pigment" refers to insoluble color matter used in finely divided dispersed form to impart color to the ink. As used herein, "dye" refers to a colorant soluble in the continuous phase of the ink. As used herein, "binder" refers to the adhesive component of the ink composition.

Suitable ink compositions of the present invention include but are not limited to those ink compositions that are in the form of a liquid at room temperature (i.e.; a temperature of about 20° C.). The ink compositions will preferably utilize water as a vehicle and pigment as a colorant.

A binder is generally needed for the ink to adhere to the surface of the substrate. In general, rub-off resistance of the ink composition increases as adherence of the ink to the surface of the substrate increases. Ink compositions which include binders comprised of film-forming polymers tend to have improved adherence of the ink to the surface of the substrate in comparison to inks containing non film-forming binders.

A non-limiting list of optional additives which may be added to the finished ink compositions or the print enhancing solvent of the present invention include crosslinking agents, printing press hygiene control agents, humectants, corrosion control agents, pH control agents, viscosity modifiers, preservatives, and defoamers.

Crosslinking agents are generally added to the finished ink composition or to a pigment dispersion. As used herein, "finished ink composition" refers to an ink composition that contains the key components such as a vehicle, pigment, and binder so as to render the ink composition ready to use. As used herein, "pigment dispersion" refers to a composition comprised of pigment solids, surfactant, and a vehicle such as water or oil to which a binder is added.

Crosslinking agents are believed to enhance the rub-off resistance of the ink by crosslinking with the ink. Glycerin or other humectants may also be added to the ink composition of the present invention in order to improve ink rub-off resistance, press hygiene, process efficiency, or process reliability.

Methods of curing the inks of the present invention include but are not limited to thermally curing, electron beam curing, photon curing (for example ultraviolet light, x-ray, and gamma ray), and combinations thereof.

There are many ways in which inks can be deposited on a substrate including flexography, direct gravure, offset gravure, lithography, letterpress, intaglio, and ink jet. It is desirable that the process by which these inks are deposited on the substrate deliver consistent product over long periods of time. Ink or fiber deposits on the printing apparatus can require manual intervention to remove. Significant manual intervention causes unacceptable costs to be associated with the process. Therefore, it is desirable to limit the amount of manual intervention needed to print reliably and consistently.

In particular, inks which include binders that are highly rub resistant tend to cause more print defects due to buildup on the printing plates. This becomes especially problematic when using a flexographic printing process. Therefore, it is desirable to minimize the use of these highly rub resistant binders while still maintaining low ink rub-off. Additionally, it has been found that printed paper products which exhibit higher color densities tend to have higher levels of ink rub-off, all else being equal.

The present invention enables the printing process to deliver higher color densities while still maintaining low ink rub-off by more efficiently dispersing the ink on the surface of the paper. Additionally, it has been discovered that this more efficient ink dispersion can be accomplished without degrading the macroscopic appearance of the print image.

On textured substrates, a 100% dot coverage area on the printing plate may not produce a solid print image on the substrate due to irregularities on the surface of the substrate which remain unprinted. Therefore, this invention may have particular application to substrates with relatively high texture (including but not limited to substrates such as absorbent disposable paper products).

Print Enhancing Fluid

Utilizing a print enhancing fluid according to the present invention provides for a more efficient dispersion of the ink onto the surface of the paper product. While not wishing to be bound by theory, the print enhancing fluid may increase the mobility of the ink thereby creating a more efficient distribution of the ink on the surface. The net result of this invention is an aesthetic improvement in the print image obtained via an increase in color density without increasing ink consumption or ink rub-off. Furthermore, this aesthetic improvement is also achieved without requiring a change in size or frequency of individual print elements.

Suitable liquids which may be utilized as print enhancing fluid include polar and nonpolar fluids. The print enhancing fluid can be hydrophilic or hydrophobic. The print enhancing fluid can be in the form of a solution or emulsion. The print enhancing fluid can be used in conjunction with any type of ink including but not limited to oil based inks, solvent based inks, and preferably water based inks. Furthermore, it can be used in conjunction with dye based inks and preferably pigment based inks. While not wishing to be bound by theory, it is believed that any fluid which is miscible with the ink is suitable as a print enhancing fluid.

Non-limiting examples of suitable print enhancing fluids include water, oil, alcohol, and mixtures thereof, preferably water, alcohol, or an alcohol-water mixture, and most preferably water.

Optional additives may be added to the print enhancing fluid. A non-limiting list of optional additives which may be added include crosslinking agents, printing press hygiene control agents, surfactants, fixatives, humectants, corrosion control agents, pH control agents, viscosity modifiers, preservatives, odor control agents, binders, colorants, and/or defoamers. If added, optional additives comprise less than about 50% of the print enhancing fluid by weight, preferably less than about 25% of the print enhancing fluid by weight, and most preferably less than about 5% of the print enhancing fluid by weight. These optional additives may be added to the print enhancing fluid so long as the resultant mixture is miscible with the ink and fluid enough that the pigment particles are mobile in the fluid.

Applying Ink and the Print Enhancing Fluid to the Substrate

The print enhancing fluid is applied to the substrate prior to the ink. The print enhancing fluid may be applied directly or indirectly to the substrate.

The print enhancing fluid is applied to the substrate in an amount of from about 1 $g/m^2$ to 50 $g/m^2$, preferably from about 5 $g/m^2$ to 30 $g/m^2$, and most preferably from about 10 $g/m^2$ to 20 $g/m^2$.

The print enhancing fluid can be used in conjunction with any type of printing application including but not limited to ink jet, rotogravure, letterpress, intaglio, lithography, silk screen, and preferably flexography. When using a print enhancing fluid on a multi-color printing press, the fluid may be applied if desired prior to one or more of the print stations.

If desired the print enhancing fluid may be applied in registration with the print image. As used herein, "registration" refers to aligning the application of the print enhancing fluid with the application of ink.

While not wishing to be bound by theory, it is believed that the amount of print enhancing fluid required may depend on the absorbency of the substrate. That is, a substrate with a relatively high absorbency may require more print enhancing fluid than a sheet with a relatively low absorbency.

Figure 3:
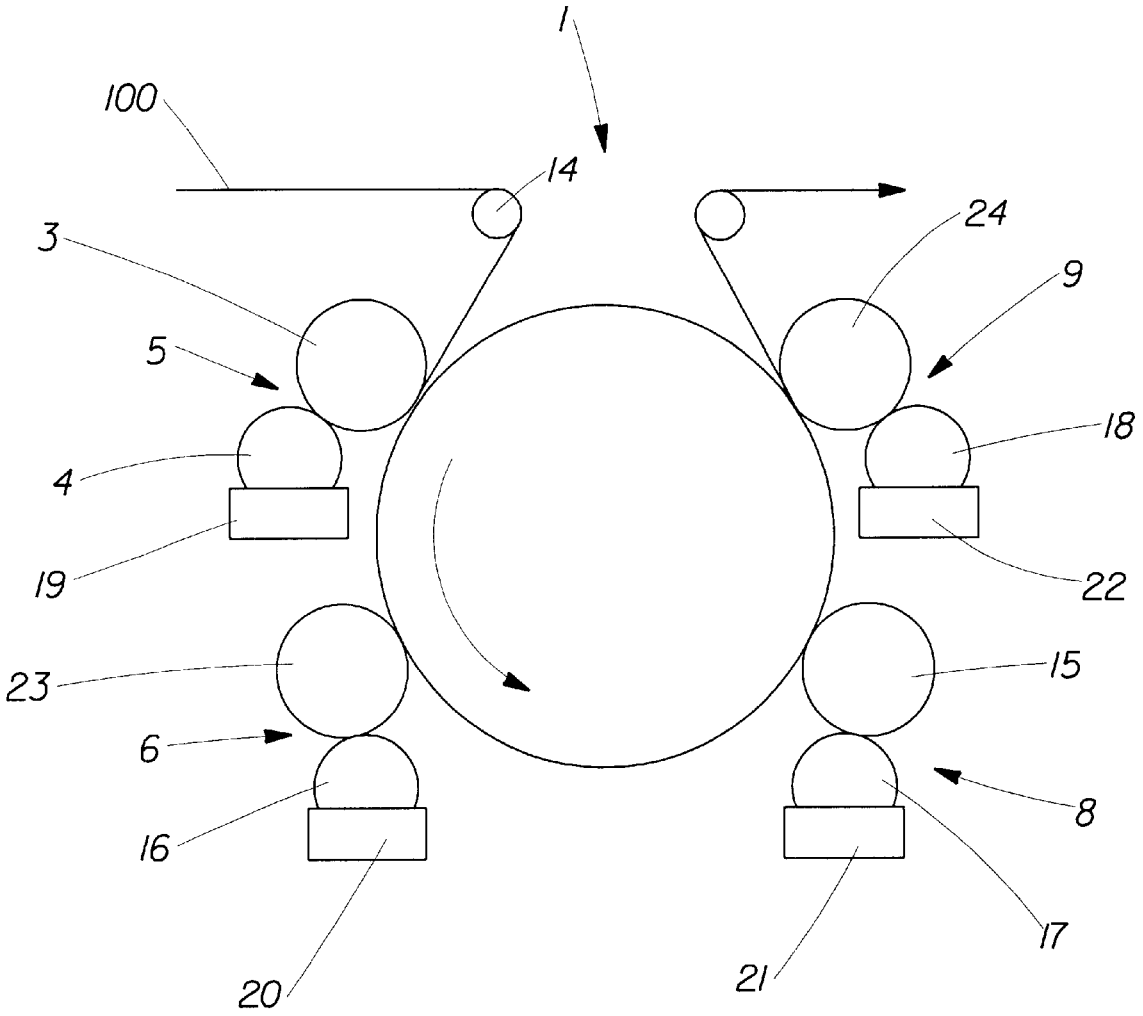
FIG. 3 is a schematic side elevational view of a printing press suitable for use with the present invention.

Referring to FIG. 3, a multicolor printing press 1 useful with the present invention is shown. Printing press 1 has four print stations. The print enhancing fluid may be applied prior to first print station 5. Alternatively, if desired the print enhancing fluid may be added to each of first print station 5, second print station 6, third print station 8, and fourth print station 9.

Furthermore, if variable color density is desired for only one particular color the print enhancing fluid may be added just before that particular print station. For multicolor printing in some instances it may be desirable to apply the print enhancing fluid between print stations such that the indicia applied to the substrate 100 at the immediately preceding print station does not exhibit variable color density but any indicia applied to the substrate 100 after the application of the print enhancing fluid does exhibit variable color density.

Any combination of addition points obvious to those of ordinary skill in the art may be used so long as the print enhancing fluid is added prior to the ink.

For example, referring to the printing press 1 of FIG. 3, if variable color density is only desired for substrate 100 image area produced by the ink of the third print station 8, the print enhancing fluid would have to be applied to substrate 100 after second print station 6 but before third print station 8 plate cylinder 15.

Alternatively, or in addition to, print enhancing fluid may be applied directly to one or more of first print station 5 anilox roll 4, second print station 6 anilox roll 16, third print station 8 anilox roll 17, or fourth print station 9 anilox roll 18. The print enhancing fluid can be sprayed onto the anilox roll. Alternatively, or in addition to, print enhancing fluid may be applied to one or more of first print station 5 print fluid pan 19, second print station 6 print fluid pan 20, third print station 8 print fluid pan 21, or fourth print station 9 print fluid pan 22.

Alternatively, or in addition to, print enhancing fluid may be applied directly (for instance by spraying) to one or more of first print station 5 plate cylinder 3, second print station 6 plate cylinder 23, third print station 8 plate cylinder 15, or fourth print station 9 plate cylinder 24.

All of the above are intended to be non-limiting examples of print enhancing fluid application points. These are for illustrative purposes and are not intended to limit the scope of the invention. Other application points and other application methods familiar to those of ordinary skill in the art may also be utilized and are intended to be covered within the scope of the present invention.

Ink may be applied to the substrate directly or indirectly in any number ways including but not limited to: dipping the substrate into a solution of ink, spraying a solution of ink onto the substrate, or preferably by printing the ink onto the substrate. The print enhancing fluid may be applied to the paper in like manner.

Additionally, combinations of the various application methods may be used (i.e.; spraying a portion of the print enhancing fluid onto the substrate while printing the print enhancing fluid onto the substrate).

Printing processes suitable for this invention include but are not limited to: lithography, letterpress, ink jet printing, gravure, screen printing, intaglio and preferably flexography. Likewise, combinations and variations thereof are considered to be within the scope of the present invention. A single color image or multi-color image may be applied to the substrate. Devices suitable for applying an image onto a sanitary disposable paper in accordance with the present invention are described in commonly assigned U.S. Pat. No. 5,213,037 issued to Leopardi, II on May 25, 1993; U.S. Pat. No. 5,255,603 issued to Sonneville et al. issued on Oct. 26, 1993; and U.S. Pat. No. 6,096,412 issued to McFarland et al. on Aug. 1, 2000, the disclosures of which are incorporated herein by reference.

The printed image produced on the paper can be line work, halftoning, preferably a process print, or a combination of these. As used herein, "process print" refers to a halftone color print created by the color separation process whereby an image composed of two or more transparent inks is broken down into halftone dots which can be recombined to produce the complete range of colors of the original image.

Coloration in a process print image is produced by varying the amount of ink deposited in a given image area and by overlaying different color inks in order to produce the desired color(s) in the image area (i.e.; for example applying cyan ink over magenta ink, etc.). The ink deposition area may be varied by adjusting the frequency, size, or combination thereof of halftone dots.

An image is process printed, if the image is printed with two or more colors. Furthermore, the inks may produce a multitude of colors when the inks are overlayed. The advantage of a process printed image over a line work printed image is that the process printed image enables many colors and shades of those colors to be produced with a few inks.

For example, a full color image may be comprised of ten or more colors. This image can be reproduced by process printing utilizing as few as three colors. The same image reproduced by line work would typically require ten or more inks each with a corresponding printing station on the printing press. A printed image produced by line work often increases both the cost and the complexity of reproducing the image. Though the preferred ink compositions of the present invention are pigment-based process inks, other types of pigment-based and dye-based inks are within the scope of this invention.

As used herein, "transparent ink" refers to an ink which has minimal hiding power thus allowing some of the light to pass through it. With a transparent ink, light must be able to penetrate one or more ink layers while only certain wavelengths are absorbed. To make a red, for example, yellow is printed over magenta. Yellow absorbs blue wavelengths allowing red and green wavelengths to pass through. Magenta absorbs green wavelengths. The remaining wavelengths are reflected as red.

In contrast to transparent inks, when opaque inks (i.e.; non-transparent inks) are overlayed, the top color is the dominant color since it absorbs most light other than the specific wavelengths of its color. For example, an opaque yellow ink would absorb blue wavelengths while reflecting the red and green wavelengths to produce a yellow.

While the present invention may be used for any combination of single color, multi-color, or process printing, it is of particular use in process printing. While not wishing to be bound by theory, it is believed that each successive color will exhibit a response to the print enhancing fluid when process printing, unless the fluid is completely absorbed into the substrate or volatilized.

Another benefit of the present invention is that it provides a means for increasing the color density of the print image. This increase in color density allows for a wider color pallet to be printed thereby creating a more aesthetically pleasing product. As used herein, "color pallet" refers to the total range of colors which can be produced by a printing process.

Additionally, it has been found that registering the application of the print enhancing fluid with the ink can be advantageous to some processes. Registering the application of the print enhancing fluid with the application of ink allows for selective application of the print enhancing fluid to the substrate wherein some, but not all areas of the substrate may have print enhancing fluid applied thereon. This selective application reduces the consumption of the print enhancing fluid as well as provides for a wider array of print image qualities. For example, a single print image having regions where the print enhancing fluid is applied and regions where the print enhancing fluid is not applied will have a wider color pallet.

Another benefit of the present invention is the ability at a given color density to reduce the ink usage rate versus printing the same color density in accordance with the prior art.

Yet another benefit of the present invention relates to printing on textured substrates such as absorbent disposable paper products. Traditionally when printing on textured substrates a 100% dot coverage area on the printing plate may not produce a 100% dot coverage print image on a textured substrate. This is due to irregularities on the surface of the textured substrate which remain unprinted. Therefore, the present invention may have particular application to substrates with relatively high texture.

Color Density of a Printed Image

The color density of an image may be measured with a densitometer. Color density, a dimensionless measurement, refers to the density of the color produced by the ink. The higher the color density of the ink, the greater the intensity or strength of the color. As color density increases, the densitometer measurements also increase. The densitometer measures the color density of the dominant primary color present in the image. The densitometer then displays the color density of the dominant primary color. As used herein, "primary color" refers to one of the four colors of yellow, cyan, magenta, and black.

The color density of an image printed on a paper product may be measured as follows: Using a reflectance densitometer, the densitometer setting is adjusted so as to read the dominant primary color present in the image. The printed paper product sample is placed on top of four unprinted sheets. The four unprinted sheets are used in order to eliminate the influence of background color from a colored surface.

These four sheets of a white substrate having an L*a*b* value, of about 91.17, 0.64, and 4.29, respectively may be used wherein the L*a*b* value is measured by a spectrocolorimeter set to a 10° observer angle with illuminant A in the CIELAB L*a*b* mode. A white substrate having an L*a*b* value of about 91.17, 0.64, and 4.29 respectively is white BOUNTY® paper towel marketed by the instant assignee.

Three color density measurements are made within a given color of an image using the reflectance densitometer. The average of the three measurements is calculated and recorded.

Color density measurements may be measured on any ink that is applied to any color substrate. Preferably color density is measured on any substrate with a white background having an L*a*b* of about 91.17, 0.64, and 4.29, respectively. A suitable densitometer for measuring color density is the X-RITE 418 reflectance densitometer commercially available from X-Rite, Inc. of Grandville, Mich.

As used herein, "L*a*b*", refers to the CIELAB L*a*b* color definition system. The CIELAB L*a*b* color definition system evaluates the color variation in a defined area of a sample and compares this variation to that of a standard reference. The colors are defined by a set of mathematical functions known as L*a*b* values, which describe the human eye's sensitivity to color. The L* relates to the lightness of the sample. The a* refers to the redness of the sample if the value of a* is positive. If the value of a* is negative, it refers to the greenness of the sample. The b* refers to the yellowness of the sample if the value of b* is positive. If the value of b* is negative, it refers to the blueness of the sample. From the L*a*b* values a ΔE value, a dimensionless measurement, can be determined wherein ΔE represents the difference in color between two different sets of L*a*b* values. The greater the ΔE, the greater the color difference.

EXAMPLES

Example 1

An embodiment of the present invention wherein the ink is applied using a flexographic printing press and the print enhancing fluid is applied by spraying.

Commercially available BOUNTY® (white) paper towel marketed by the instant assignee was utilized for this example. A four color flexographic printing press as shown in FIG. 3 was used to print on the BOUNTY® paper towel. Four inks commercially available from Sun Chemical Corporation of Northlake, Ill. were used.

Referring to FIG. 3, a yellow ink (commercially available from Sun Chemical as No. 1696651) was added to first print station 5 print fluid pan 19. A magenta ink (commercially available from Sun Chemical as No. 1696652) was added to second print station 6 print fluid pan 20. A cyan ink (commercially available from Sun Chemical as No. 1696653) was added to third print station 8 print fluid pan 21. A black ink (commercially available from Sun Chemical as No. 1696654) was added to fourth print station 9 print fluid pan 22.

The plate cylinder squeeze settings and registration were adjusted using standard techniques known in the art. For comparison purposes a control substrate was printed according to the prior art.

Substrate 100 was then printed according to the present invention. Water was applied to substrate 100 prior to first print station 5. The water was applied using a high pressure-low volume spray gun, commercially sold as Binks Model 95, available from ITW Industrial Finishing of Glendale Heights, Ill. The water addition rate to substrate 100 was approximately 20 g/m$^2$.

The results are shown in Table I. Referring to Table I, the color density of the control towel and the towel printed according to the present invention was measured for each color printed. Color density was measured in accordance with the measurement procedures previously described in the instant specification. As can be seen, for each color printed, the color density of the towel printed according to the present invention is significantly higher than the towel printed according to the prior art.

TABLE I

| | Color Density (Prior Art Control) | Color Density (Present Invention) |
|---|---|---|
| Yellow | 0.45 | 0.50 |
| Magenta | 0.59 | 0.73 |
| Cyan | 0.56 | 0.75 |
| Black | 0.49 | 0.64 |

Example 2

An embodiment of the current invention wherein the ink is applied using a flexographic press and the print enhancing fluid is applied by flexographic printing.

Commercially available BOUNTY® (white) paper towel marketed by the instant assignee was utilized for this example. Two print stations (i.e.; first print station 5 and second print station 6) of a four color flexographic printing press 1 as shown in FIG. 3 was used to print on the BOUNTY® paper towel. A water based magenta ink sold as WKJFW2618915 commercially available from Sun Chemical Corporation of Northlake, Ill. was used for this purpose.

The print plates were photopolymer printing plates as is known in the art. The print plate on first print station 5 plate cylinder 3 utilized a 20% dot coverage area at a 65 linescreen. The second print station 6 plate cylinder 23 utilized 5%, 10%, 15%, 25%, 75%, and 100% dot coverage areas, all at a 65 linescreen.

The plate cylinder squeeze settings and registration were adjusted using standard techniques known in the art. For comparison purposes a control substrate was printed according to the prior art wherein magenta ink was applied at the second print station 6. No print enhancing fluid was applied to the control substrate.

Substrate 100 was then printed according to the present invention. Referring to FIG. 3, water was applied to the first print station 5 print fluid pan 19. It is estimated that approximately 11 g/m$^2$ of water was transferred from the first print station 5 printing plate to substrate 100.

The results are shown in Table 2. Referring to Table 2, the color density of the control towel and the towel printed according to the present invention was measured for each magenta % dot coverage area of the printed towel. Color density was measured in accordance with the measurement procedures previously described in the instant specification. As can be seen, for each % dot coverage area, the color density of the towel printed according to the present invention is significantly higher than the towel printed according to the prior art.

TABLE 2

| % Dot | Color Density (Prior Art Control) | Color Density (Present Invention) |
|---|---|---|
| 5 | 0.28 | 0.38 |
| 10 | 0.30 | 0.45 |
| 15 | 0.35 | 0.55 |
| 25 | 0.45 | 0.69 |
| 50 | 0.63 | 0.84 |
| 75 | 0.68 | 0.89 |
| 100 | 0.72 | 0.87 |

While particular embodiments of the present invention have been illustrate and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. The method for printing indicia said method comprising the steps of:

(a) providing a printing press;

(b) applying a substrate to said printing press, said substrate having a first outer surface and a second outer surface opposed thereto;

(c) applying from about 1 g/m$^2$ to 50 g/m$^2$ of a print enhancing fluid to at least one of said first outer surface and said second outer surface of said substrate;

(d) applying indicia to at least one of said first outer surface and said second outer surface of said substrate wherein said indicia is comprised of ink and wherein said ink contacts said print enhancing fluid on at least one of said first outer surface or one of said second outer surface of said substrate said indicia including a color density whereby said color density of said indicia is enhanced.

2. The method of claim 2 wherein said printing press is a flexographic printing press having at least one print station.

3. The method of claim 1 wherein said print enhancing fluid is applied to said substrate by dipping said substrate into said print enhancing fluid, spraying said print enhancing fluid onto said substrate, printing said print enhancing fluid onto said substrate, or combinations thereof.

4. The method of claim 2 wherein said print enhancing fluid is applied to a plate cylinder of said flexographic printing press, applied to an anilox roll of said flexographic printing press, applied to said substrate or combinations thereof.

5. The method of claim 1 wherein said substrate is an absorbent disposable paper product.

6. The method of claim 5 wherein said absorbent disposable paper product is a paper towel, bath tissue, or facial tissue.

7. The method of claim 6 wherein said absorbent disposable paper product is a paper towel.

8. The method of claim 1 wherein said print enhancing fluid is miscible with said ink.

9. The method of claim 1 wherein said ink is water-based.

10. The method of claim 9 wherein said ink is a process ink.

11. The method of claim 8 wherein said print enhancing fluid is water, alcohol, oil, or mixtures thereof.

12. The method of claim 11 wherein said print enhancing fluid is water.

13. The method of claim 1 wherein said substrate comprises materials which are cellulosic, noncellulosic, or a combination thereof.

14. The method of claim 13 wherein said substrate is cellulosic.

15. The method of claim 13 wherein said substrate is a nonwoven.

16. The method of claim 1 wherein said printing press has at least one print station and wherein said print enhancing fluid is applied to said substrate prior to the first print station.

17. The method of claim 1 wherein said print enhancing fluid is applied directly to said substrate.

18. The method for printing indicia, said method comprising the steps of:

(a) providing a substrate having a first outer surface and a second outer surface opposed thereto;

(b) applying from about 1 g/m$^2$ to 50 g/m$^2$ of a print enhancing fluid to at least one of said first outer surface and said second outer surface of said substrate;

(c) applying indicia to at least one of said first outer surface and said second outer surface of said substrate wherein said indicia is comprised of ink and wherein said ink contacts said print enhancing fluid on at least one of said first outer surface or one of said second outer surface of said substrate said indicia including a color density whereby said color density of said indicia is enhanced.

19. The method for printing indicia, said method comprising the steps of:

(a) providing a substrate having a first outer surface and a second outer surface opposed thereto;

(b) applying a print enhancing fluid comprising water, alcohol, oil, or mixtures thereof to at least one of said first outer surface and said second outer surface of said substrate;

(c) printing an image on at least one of said first outer surface and said second outer surface of said substrate wherein said image is comprised of ink and wherein said ink contacts said print enhancing fluid on at least one of said first outer surface or said second outer surface of said substrate said image including a color density whereby said color density of said image is enhanced.

20. The method of claim 19 wherein said print enhancing fluid further comprises a surfactant.

21. The method of claim 19 wherein said print enhancing fluid further comprises a binder.

22. The method of claim 19 wherein said print enhancing fluid further comprises a pH control agent.

23. The method of claim 19 wherein said print enhancing fluid is applied in registration with said image.

* * * * *